US009228282B2

(12) United States Patent
Kappler et al.

(10) Patent No.: US 9,228,282 B2
(45) Date of Patent: Jan. 5, 2016

(54) VERTICAL AXIS WASHING MACHINE HAVING STEAM FEATURES

(75) Inventors: Jerrod Aaron Kappler, Louisville, KY (US); Alaknanda Acharya, Louisville, KY (US); Michael Wuttikorn Ekbundit, Mount Washington, KY (US)

(73) Assignee: General Electric Company, Schenectady, NY (US)

( * ) Notice: Subject to any disclaimer, the term of this patent is extended or adjusted under 35 U.S.C. 154(b) by 999 days.

(21) Appl. No.: 13/281,986

(22) Filed: Oct. 26, 2011

(65) Prior Publication Data

US 2013/0104316 A1 May 2, 2013

(51) Int. Cl.

| | |
|---|---|
| ***D06F 17/10*** | (2006.01) |
| ***D06F 33/02*** | (2006.01) |
| *D06F 39/00* | (2006.01) |
| *D06F 23/00* | (2006.01) |
| *D06F 73/02* | (2006.01) |

(52) U.S. Cl.

CPC ..... *D06F 33/02* (2013.01); *D06F 23/00* (2013.01); *D06F 39/008* (2013.01); *D06F 73/02* (2013.01); *D06F 2202/085* (2013.01); *D06F 2204/04* (2013.01)

(58) Field of Classification Search

CPC ..... D06F 39/008; D06F 17/12; D06F 21/06; D06F 21/08; D06F 37/12; D06F 37/14; D06F 37/145; D06F 37/16; D06F 37/18; D06F 37/20; D06F 23/04; D06F 2058/2809; D06F 2058/2848; D06F 2058/2861; D06F 2202/10; D06F 39/002; D06F 39/003

USPC ..... 68/5 R, 5 C

See application file for complete search history.

(56) References Cited

U.S. PATENT DOCUMENTS

| | | | | |
|---|---|---|---|---|
| 3,402,576 | A * | 9/1968 | Krupsky | 68/4 |
| 2005/0144735 | A1* | 7/2005 | Yang | D06F 35/006 8/149.3 |
| 2005/0252250 | A1* | 11/2005 | Oh | D06F 33/02 68/12.03 |
| 2006/0137107 | A1* | 6/2006 | Lee | D06F 25/00 8/149.3 |
| 2007/0283506 | A1* | 12/2007 | Wong et al. | 8/149.3 |
| 2008/0022551 | A1* | 1/2008 | Banta | D06F 58/04 34/602 |
| 2009/0113944 | A1 | 5/2009 | Kim et al. | |
| 2009/0235464 | A1* | 9/2009 | Cassidy | D06F 17/04 8/137 |

* cited by examiner

*Primary Examiner* — Michael Kornakov
*Assistant Examiner* — Marc Lorenzi
(74) *Attorney, Agent, or Firm* — Dority & Manning, P.A.

(57) ABSTRACT

One exemplary embodiment of the present disclosure is directed to a vertical axis washing machine. The washing machine includes a cabinet having a top portion with a lid and side portions extending downwardly from the top portion. A tub is positioned within the cabinet with a basket rotatably supported within the tub. The washing machine also includes a heater and a water level sensor. The water level sensor controls the volume of water that enters the tub and the heater generates steam from such volume of water.

14 Claims, 3 Drawing Sheets

VERTICAL AXIS WASHING MACHINE HAVING STEAM FEATURES

FIELD OF THE INVENTION

The present disclosure relates generally to washing machines, and more particularly to vertical axis washing machines with steam features.

BACKGROUND OF THE INVENTION

Washing machines typically include a cabinet which receives a stationary tub for containing wash and rinse water. A wash basket is rotatably mounted within the wash tub, and an agitating element is rotatably positioned within the wash basket. A drive assembly and a brake assembly can be positioned with respect to the wash tub and configured to rotate and control the agitation of the wash basket to cleanse the wash load loaded into the wash basket. Upon completion of a wash cycle, a pump assembly can be used to rinse and drain the soiled water to a draining system.

Certain horizontal axis washers are equipped with the capability to produce steam inside the cabinet. However, there are currently no vertical axis machines that satisfactorily provide this capability.

Thus, a need exists for a top load washing machine that provides steam features. Methods related to such a washing machine would be particularly useful.

BRIEF DESCRIPTION OF THE INVENTION

Aspects and advantages of the invention will be set forth in part in the following description, or may be obvious from the description, or may be learned through practice of the invention.

One exemplary embodiment of the present disclosure is directed to a vertical axis washing machine. The washing machine includes a cabinet having a top portion with a lid and side portions extending downwardly from the top portion. A tub is positioned within the cabinet with a basket rotatably supported within the tub. The washing machine also includes a heater and a water level sensor. The water level sensor controls the volume of water that enters the tub and the heater generates steam from such volume of water.

Another exemplary embodiment is directed to a method for operating a vertical axis washing machine. The washing machine includes a cabinet having a top portion with a lid and side portions extending downwardly from the top portion. A tub is positioned within the cabinet with a basket rotatably supported within the tub. The washing machine also includes a heater and a water level sensor. The method includes adding water to the tub until a predetermined volume of water has been added. The volume of water is only sufficient for generating steam. The water level sensor is utilized to determine when the predetermined volume of water has been added. The method further includes initiating the heater after the predetermined volume of water has been added to generate steam from the predetermined volume of water.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
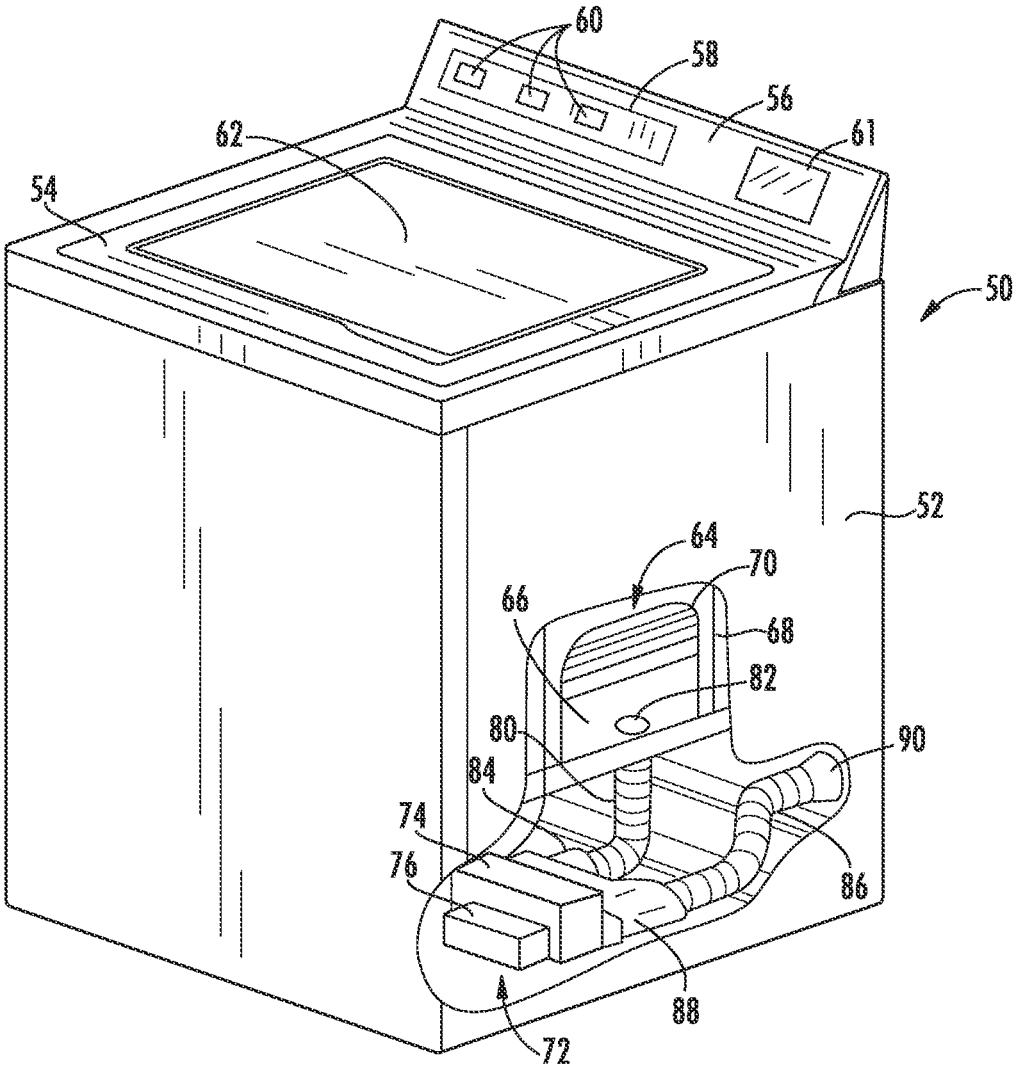
FIG. 1 is a perspective cutaway view of an exemplary top load washing machine according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to a top-loading washing machine that includes the ability to produce steam. When a predetermined, level of water is added to the washer as determined by one or more water level sensor(s), a heater is utilized to produce steam within the washer, Steam can be utilized to remove wrinkles in garments as well as for more efficient cleaning of garments.

FIG. 1 is a perspective view partially broken away of an exemplary top load (vertical axis) washing machine 50 including a cabinet 52 having a top portion 54. A backsplash 56 extends from top portion 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and other items of interest to machine users. A lid 62 is mounted to top portion 54 and is rotatable about a hinge (not shown) between an open position (not shown) facilitating access to wash tub 64 located within cabinet 52, and a closed position (shown in FIG. 1) forming an enclosure over wash tub 64.

Tub 64 includes a bottom wall 66 and a sidewall 68, and a basket 70 is rotatably mounted within wash tub 64. The top portion of tub 64 generally defines a tub opening (not shown). A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine drain outlet 90 and ultimately to a building plumbing system discharge line (not shown) in flow communication with drain outlet 90.

Figure 2:
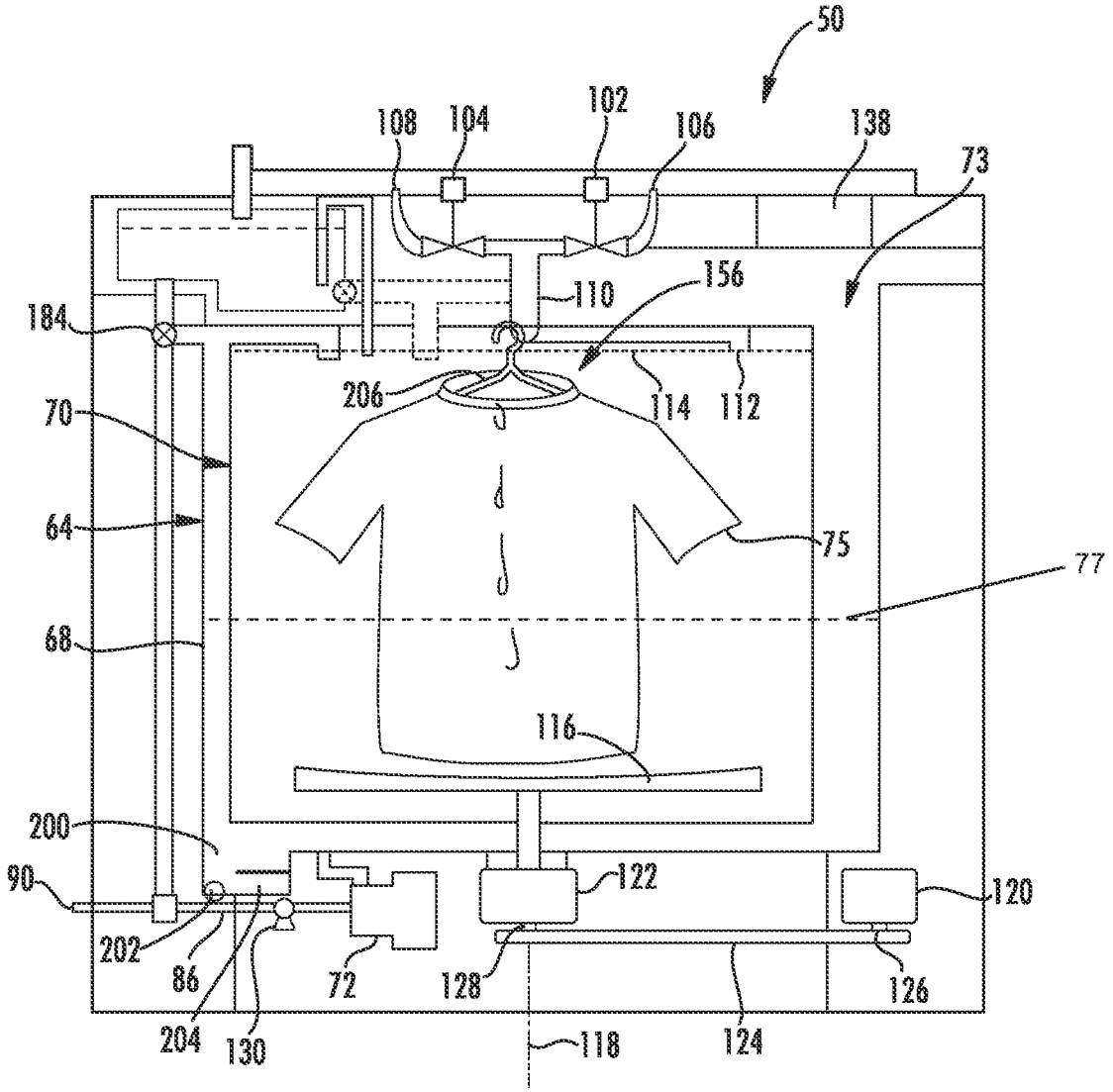
FIG. 2 is a front schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 68 and tub bottom. A wash load such as garment 75 is disposed within basket 70. The top portion of tub 64 generally defines a tub opening 73. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (shown in FIG. 3, not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as an impeller is disposed in basket 70 to impart an oscillatory motion to garments and liquid in basket 70 while leaving sufficient room to hang a garment as will be described in more detail herein. As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. The drive system may also be of the direct type where no belt is necessary and the motor is directly inline with the drive shaft. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, the transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used.

Operation of machine 50 is controlled by a controller 138 which is operatively coupled to the user interface input located on washing machine backsplash 56 (shown in FIG. 1) for user manipulation to select washing machine cycles and features such as wash cycles and steam cycles as will be described in more detail herein. In response to user manipulation of the user interface input, controller 138 operates the various components of machine 50 to execute selected machine cycles and features.

Figure 3:
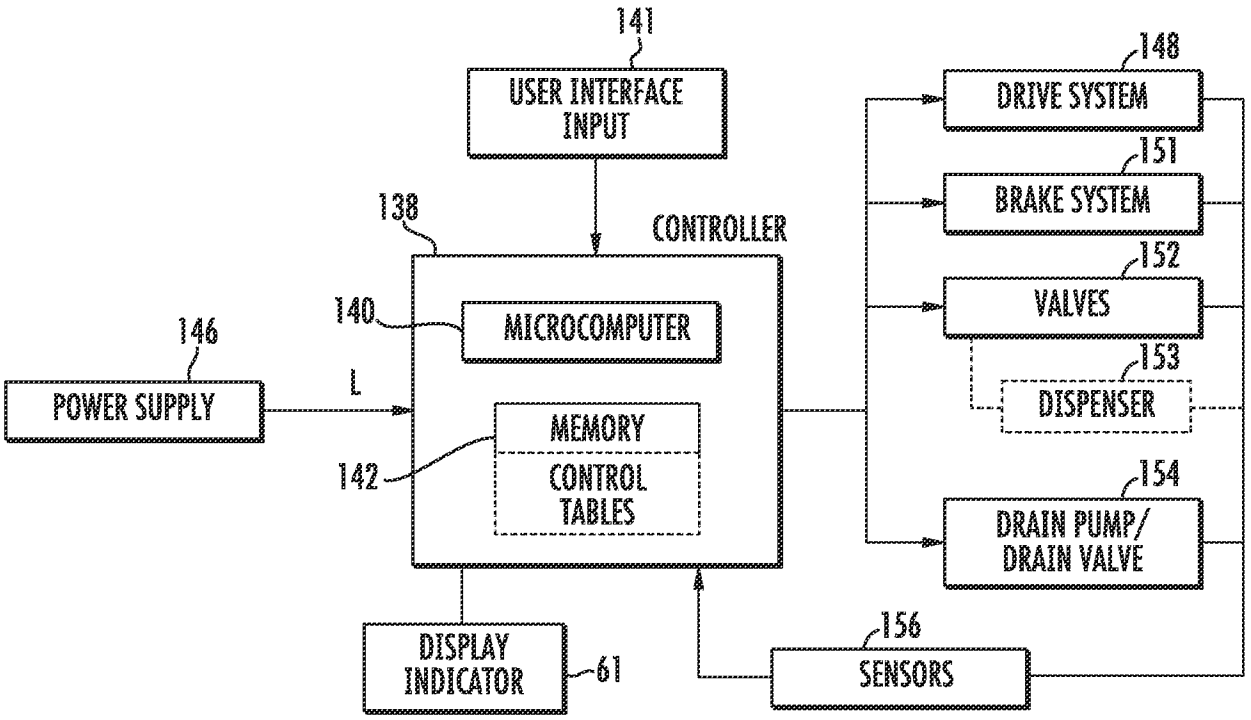
FIG. 3 is a schematic block diagram of a control system for the washing machine shown in FIG. 1 and FIG. 2 in accordance with certain aspects of the present disclosure.

Referring to FIG. 3, controller 138 can, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to controller 138 can be provided by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to water level sensor 202 and heater 204 (as further described herein) in addition to machine drive system 148 (e.g., motor 120, clutch system 122, and agitation element 116 shown in FIG. 2), a brake assembly 151 associated with basket 70 (shown in FIG. 2), machine water valves 152 (e.g., valves 102, 104 and diverter valve 184 shown in FIG. 2) and machine drain system 154 (e.g., drain pump assembly 72 and/or drain valve 130 shown in FIG. 2) according to known methods.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Laundry items are then rinsed and portions of the cycle repeated, including the agitation phase, depending on the particulars of the wash cycle selected by a user.

In accordance with the present disclosure, the washing machine can also advantageously permit one or more steam cycles. Heretofore, top load (vertical axis) washing machines have not included steam features. In accordance with the present disclosure, steam features are described in connection with top load washing machines. In this manner, consumers of top load washing machines can enjoy the deep clean benefits afforded by steam. The washing machines described herein can also permit reduction and/or elimination of wrinkles from garments.

Referring to FIG. 2, sump 200 is in fluid communication with tub 64. Sump 200 can be of any suitable size and/or shape to permit a volume of water to accumulate for the production of steam as will be described herein. In this manner, water can flow into tub 64 as previously described herein and fill sump 200.

Water level sensor 202 can be positioned in or adjacent to sump 200 and can control the volume of water to ensure that only a predetermined volume of water enters sump 200. Water level sensor 202 can be any suitable water level sensor as would be known to one of ordinary skill in the art. Water level sensor 202 can be in communication with controller 138 such that water level sensor 202 can cause the flow of water into tub 64 to stop when the volume of water in sump 200 reaches a predetermined sufficient volume.

In this regard, sump 200 can include heater 204. Heater 204 is immersed by the volume of water in sump 200 and once the volume of water reaches a predetermined level, heater 204 can be activated by controller 138 and increase in temperature to boil the water and generate steam. Steam can rise and fill tub 64. Any suitable heater as would be known to one of ordinary skill in the art can be utilized for such purpose. Heater can be deactivated by controller 138 when water level sensor 202 indicates that some portion or substantially all of the volume of water in sump 200 has been released into the tub 64 as steam.

Referring again to FIG. 2, washing machine 50 can also include a removable garment hanger 206. Removable garment hanger 206 can hang within tub 64. In this regard, tub 64 can define any suitable feature such as tabs, hooks, fasteners, or the like to mount removable garment hanger 206 within tub 64. In certain embodiments of the present disclosure, one or more sensors or transducers 156 can detect the presence and/or absence of removable garment hanger 206 and communicate the same to controller 138. In this manner, when removable garment hanger 206 is positioned within tub 64, the user interface 141 can optionally only permit access to steam cycle functions of the washing machine 50. However, it should be appreciated that the steam features described herein can also be used in combination with washing cycles as would be appreciated by one of ordinary skill in the art and the presence of garment hanger 206 within tub 64 does not necessarily require disabling of wash cycle features.

For instance, a regular wash load of garments can be loaded into the basket of a top load washing machine. The steam features described herein can be utilized at any suitable time during the regular wash cycle(s). In certain embodiments, the steam features can be activated to add steam in the tub after an initial wash. Similarly, in certain embodiments, one or more garments can be hung in basket and a steam cycle can be utilized to freshen such garments without the necessity for a full wash cycle. Alternatively, or in conjunction with such freshening, wrinkles can also be reduced or eliminated from the use of a steam cycle without the necessity of a full wash cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A vertical axis washing machine appliance, comprising:
a cabinet;
a lid rotatably mounted to the cabinet at a top portion of the cabinet;
a tub disposed within the cabinet;
a basket positioned within the tub, the basket rotatable about a vertical axis within the tub, the basket defining a wash chamber;
an impeller positioned within the wash chamber of the basket at a bottom portion of the wash chamber, the impeller rotatable about the vertical axis within the basket;
a garment hanger support positioned at the top portion of the cabinet over the basket, the garment hanger support positioned for supporting a garment hanger such that an article on the garment hanger is positioned within the wash chamber of the basket over the impeller;
a heater positioned within the tub at a bottom portion of the tub;
an inlet conduit having an outlet positioned at the tub;
a valve coupled to the inlet conduit;
a controller in operative communication with the valve and the heater, the controller configured for selectively actuating the valve in order to direct liquid into the tub via the inlet conduit, the controller also configured for selectively operating the heater in order to generate steam from liquid within the tub,
wherein the controller is configured to execute a wash cycle and a steam cycle,
further comprising a garment hanger sensor positioned at the garment hanger support configured to detect the presence of the garment hanger, the controller being in operative communication with the garment hanger sensor,
wherein the controller only permits access to the steam cycle in response to the garment hanger being detected by the garment hanger sensor.

2. The vertical axis washing machine appliance of claim 1, wherein the tub further comprises a sump, the sump forming a lowest portion of the wash chamber of the tub, the heater positioned within the sump.

3. The vertical axis washing machine appliance of claim 2, further comprising a liquid level sensor located or partially located within the sump, the controller in operative communication with the liquid level sensor.

4. The vertical axis washing machine appliance of claim 3, wherein the controller is configured for receiving signals from the liquid level sensor and actuating the valve in response to signals from the liquid level sensor in order to fill the sump with liquid from the inlet conduit.

5. The vertical axis washing machine appliance of claim 4, wherein the controller is configured for actuating the valve in order to fill the sump with liquid from the inlet conduit such that liquid in the tub does not contact articles within the wash chamber of the basket during the steam cycle.

6. The vertical axis washing machine appliance of claim 1, wherein the garment hanger support is positioned adjacent the lid over the impeller.

7. The vertical axis washing machine appliance of claim 1, wherein the garment hanger support is a tab or a hook formed by the tub adjacent the lid and over the impeller.

8. A vertical axis washing machine appliance, comprising:
a cabinet having a top panel;
a lid rotatably mounted to the top panel of the cabinet;
a tub disposed within the cabinet;
a basket positioned within the tub, the basket rotatable about a vertical axis within the tub;
an impeller positioned, within the basket, the impeller rotatable within the basket;

a garment hanger support positioned over the basket, the garment hanger support positioned for supporting an article within the basket over the impeller;

a heater positioned within the tub under the basket;

an inlet conduit mounted to the tub, the inlet conduit having an outlet for directing liquid from the inlet conduit into the tub;

a valve coupled to the inlet conduit;

a controller in operative communication with the valve and the heater, the controller configured for selectively opening the valve in order to direct liquid into the tub at outlet of the inlet conduit, the controller also configured for selectively operating the heater in order to generate steam from liquid within the tub, wherein the controller is configured to execute a wash cycle and a steam cycle, further comprising a garment hanger sensor positioned at the garment hanger support configured to detect the presence of the garment hanger, the controller being in operative communication with the garment hanger sensor, wherein the controller only permits access to the steam cycle in response to the garment hanger being detected by the garment hanger sensor.

9. The vertical axis washing machine appliance of claim 8, wherein the tub further comprises a sump positioned at a bottommost portion of the tub, the heater positioned within the sump.

10. The vertical axis washing machine appliance of claim 9, further comprising a liquid level sensor positioned at the sump, the controller in operative communication with the liquid level sensor.

11. The vertical axis washing machine appliance of claim 10, wherein the controller is configured for receiving signals from the liquid level sensor and actuating the valve in response to signals from the liquid level sensor in order to fill the sump with liquid from the inlet conduit.

12. The vertical axis washing machine appliance of claim 11, wherein the controller is configured for closing the valve such that liquid in the tub does not contact articles within the wash chamber of the basket during operation of the heater.

13. The vertical axis washing machine appliance of claim 8, wherein the garment hanger support is positioned adjacent the lid over the impeller.

14. The vertical axis washing machine appliance of claim 8, wherein the garment hanger support is a tab or hook formed by the tub adjacent the lid and over the impeller.

* * * * *